US007654652B2

(12) United States Patent
Tobita et al.

(10) Patent No.: US 7,654,652 B2
(45) Date of Patent: Feb. 2, 2010

(54) INK JET HEAD

(75) Inventors: Satoru Tobita, Hitachinaka (JP); Toshiharu Sumiya, Kawasaki (JP); Ryouta Matsufuji, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 314 days.

(21) Appl. No.: 11/214,822

(22) Filed: Aug. 31, 2005

(65) Prior Publication Data

US 2006/0044364 A1 Mar. 2, 2006

(30) Foreign Application Priority Data

Mar. 31, 2004 (JP) ..... 2004-251677

(51) Int. Cl.
*B41J 2/045* (2006.01)
*B41J 2/05* (2006.01)

(52) U.S. Cl. ..... 347/71; 347/65

(58) Field of Classification Search ..... 347/68–72, 347/65

See application file for complete search history.

(56) References Cited

U.S. PATENT DOCUMENTS 6,273,558 B1 * 8/2001 Kitahara ..... 347/72
6,460,981 B1 * 10/2002 Yasukawa et al. ..... 347/70

FOREIGN PATENT DOCUMENTS

JP 8-85207 4/1996
JP 2001-96738 4/2001

* cited by examiner

*Primary Examiner*—Stephen D Meier
*Assistant Examiner*—Geoffrey Mruk
(74) *Attorney, Agent, or Firm*—Antonelli, Terry, Stout & Kraus, LLP.

(57) ABSTRACT

An ink jet head having: a common ink chamber for storing an ink supplied from an ink supply part; an ink supply path for supplying the ink stored in the common ink chamber; a pressure chamber to which the ink is supplied via the ink supply path; and a nozzle for discharging the ink in the pressure chamber in accordance with a pressure change in the pressure chamber. The components being constructed by stacking a plurality of thin plate members, wherein a plurality of the ink supply paths are arranged in parallel.

10 Claims, 9 Drawing Sheets

INK JET HEAD

CLAIM OF PRIORITY

This application claims priority from Japanese application serial no. 2004-251677, the content of which is hereby incorporated by reference into this application.

FIELD OF THE INVENTION

The present invention relates to an ink jet head applied to an apparatus for printing a large sized poster, an apparatus for discharging a special solution for forming a thin film of a flat panel display, and the like.

BACKGROUND OF THE INVENTION

In recent years, the uses of an apparatus using an ink jet head are increasing and, concurrently, high-speed and high-quality printing is being requested. To meet the requests, it is necessary to drive an ink drop at high frequency and, to jet the ink drop at high frequency, to obtain an ink jet head having high frequency response, in other words, high ink drop jetting frequency.

To increase the jetting frequency of the ink drop, the techniques disclosed in Japanese Patent Laid-Open Nos. H8(1996)-85207 and 2001-96738 have been already proposed.

According to the techniques disclosed in the patent documents, high ink drop jetting frequency can be obtained. However, to fine adjustment of the ink drop jetting frequency for satisfying a slight specification change, for example, a customer's demand, the whole path plate has to be re-made. Moreover, precise processing technique is required to manufacture an ink jet head. Consequently, improvement in productivity cannot be expected.

An object of the present invention is to provide an ink jet head realizing higher ink drop jetting frequency and capable of adjusting the jetting frequency.

SUMMARY OF THE INVENTION

The present invention provides an ink jet head constructed by stacking a plurality of thin plate members so that an ink is led from a common ink chamber to a pressure chamber via an ink supply path and the ink in the pressure chamber is jetted from a nozzle in accordance with a pressure change in the pressure chamber, and the ink supply path is constructed by arranging a first ink supply path formed at the same level as that of the pressure chamber and at least one second ink supply path having the same function as that of the first ink supply path in parallel.

DETAILED DESCRIPTION OF THE PREFERRED EMBODIMENTS

Figure 1:
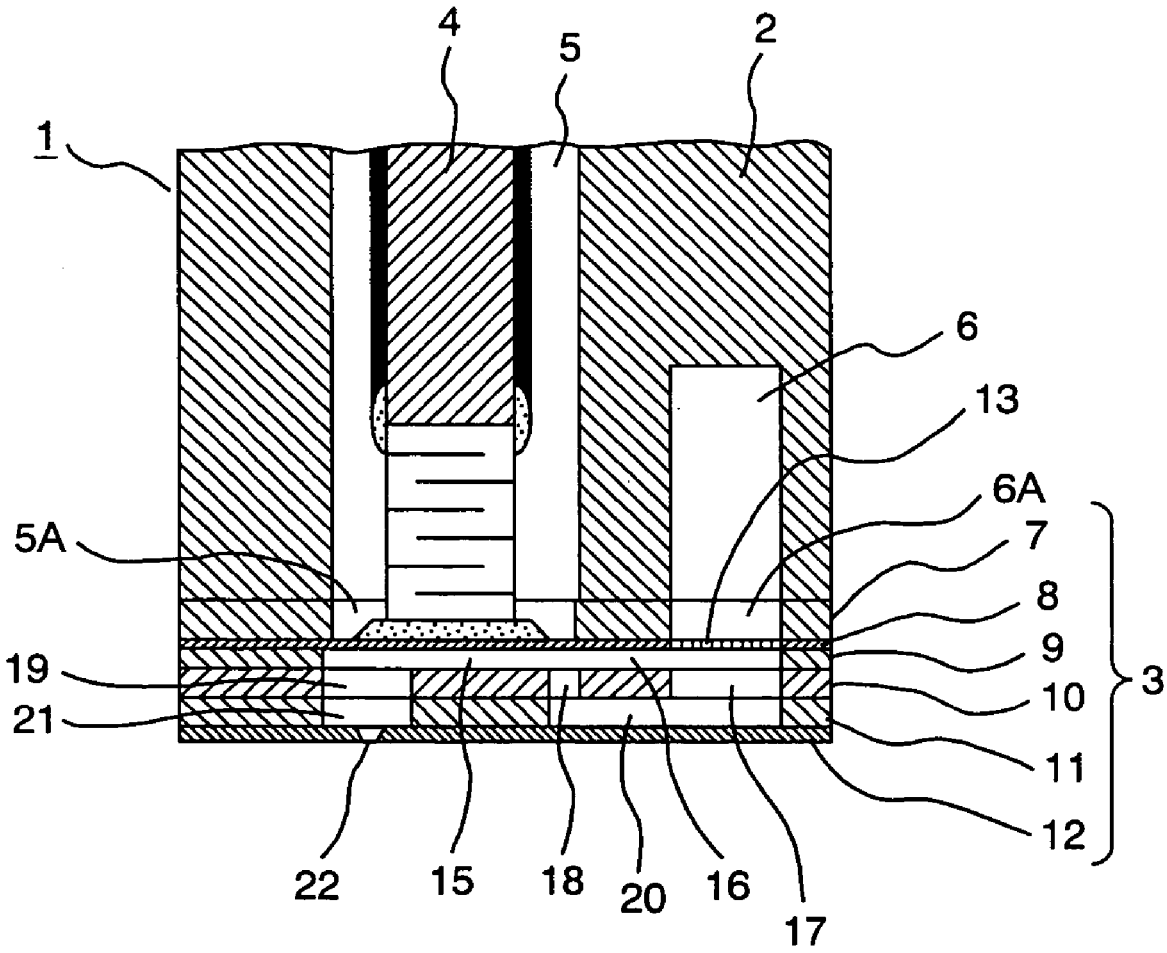
FIG. 1 is a longitudinal section showing a first embodiment of an ink jet head according to the present invention.
Figure 2:
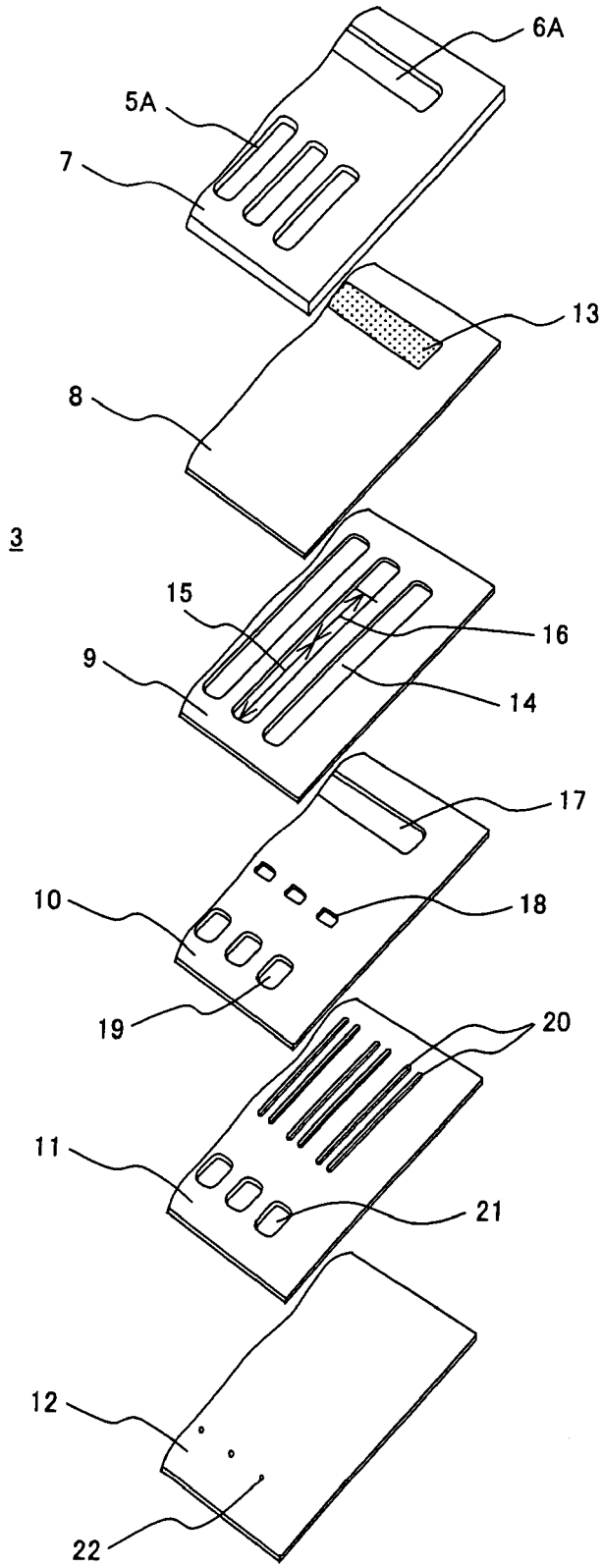
FIG. 2 is an exploded perspective view of a path plate group shown in FIG. 1.

A first embodiment of an ink jet head according to the invention will be described hereinbelow on the basis of an on-demand type line-head printing apparatus shown in FIGS. 1 and 2.

An ink jet head 1 has a housing 2 as a component of the ink jet head 1, and a path plate group 3 in which an ink path is formed by stacking a plurality of thin plate members. In the housing 2, a drive chamber 5 holding a piezoelectric element group 4 is provided in the vertical direction, and a common ink chamber 6 storing an ink that is supplied from a not-shown ink supplying part is provided. The path plate group 3 is constructed by stacking and adhering a reinforcement plate 7, a diaphragm plate 8, a restrictor plate 9, chamber plates 10 and 11, and a nozzle plate 12 by adhesion or the like at the lower end of the housing 2.

The reinforcement plate 7 is provided with drive chamber holes 5A communicated with the drive chamber 5, the number of the drive chamber holes being the number as that of nozzles to be described later. The reinforcement plate 7 is provided with an ink chamber hole 6A communicated with the common ink chamber 6. The diaphragm plate 8 is formed so as to close the drive chamber holes 5A and communicate with the ink chamber hole 6A.

A filter 13 is provided as necessary for the part communicated with the ink chamber hole 6A so that foreign matters mixed in the ink do not flow to the outside of the common ink chamber 6. The diaphragm plate 8 is formed by a thin plate member having a thickness of, for example, 15 μm or less so as to be easily displaced according to a displacement of expansion and contraction of the piezoelectric element group 4. The diaphragm plate 8 is prepared by electroforming, etching, or the like.

The restrictor plate 9 is provided with communication holes 14 communicated with the ink chamber holes 6A and the drive chamber holes 5A via the diaphragm plate 8, the number of the communication holes being the same number as that of nozzles, which will be described later.

A portion facing the drive chamber holes 5A of the communication hole 14 is used as a pressure chamber 15, and a part excluding the pressure chamber 15 and the part facing the ink chamber hole 6A is used as a first ink supply path 16.

The chamber plate 10 is provided with a communication hole 17 facing the ink chamber hole 6A, a communication hole 18 communicated with an end portion of the pressure chamber 15, and a communication hole 19 communicated with an end portion on the side opposite to the communication hole 18 of the pressure chamber 15.

The number of the communication holes 18 and that of the communication holes 19 are the same as that of the nozzles, which will be described later. Another chamber plate 11 is provided with communication holes 20 communicated with the communication holes 17 and 18, and communication holes 21 communicated with the communication holes 19. The number of the communication holes 20 and that of the communication holes 21 are at least the same as that of nozzles which will be described later. In the embodiment, two lines of the communication holes 20 are formed for one communication hole 18. A plurality of nozzles 22 communicated with the plurality of communication holes 21 are opened in the nozzle plate 12. On the side of the atmosphere of the nozzle 22, to jet ink drops stably, a water repellant film or a non-wet coating may be formed.

With the configuration, in addition to the first ink supply path 16 extending from the common ink chamber 6 to the pressure chamber 15, a second ink supply path extending from the common ink chamber 6 to the pressure chamber 15 via the communication holes 17, 20, and 18 is formed.

Desirably, for the plates of the path plate group 3 formed as described above, materials whose coefficients of linear expansion are equal to or similar to each other are used. The plates are desirably formed by, for example, thin stainless plates. In this way, a warp between the plates by elevating temperatures will be minimized.

An operation of discharging an ink from the ink jet head 1 having the configuration will now be described with reference to FIGS. 3A to 3D.

Figure 3A:
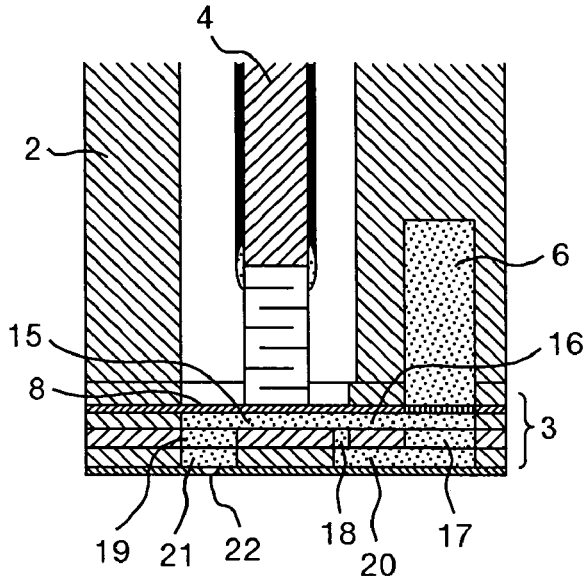
FIGS. 3A to 3D are diagrams illustrating operations of the ink jet head shown in FIG. 1.
Figure 3B:
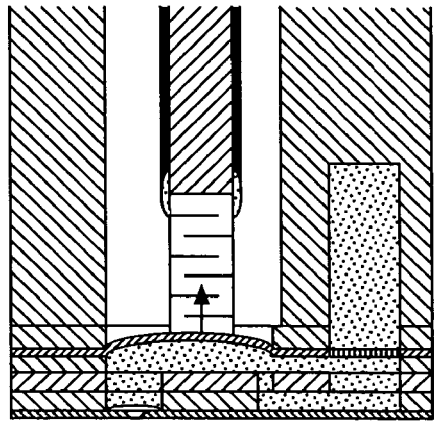
Figure 3C:
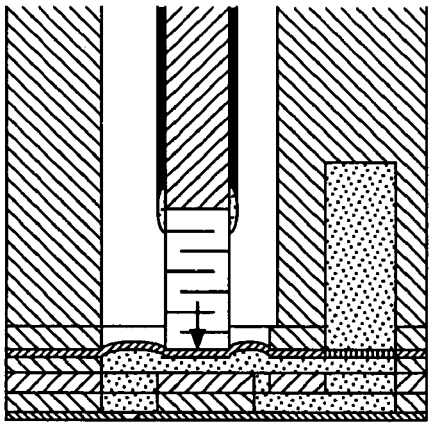
Figure 3D:
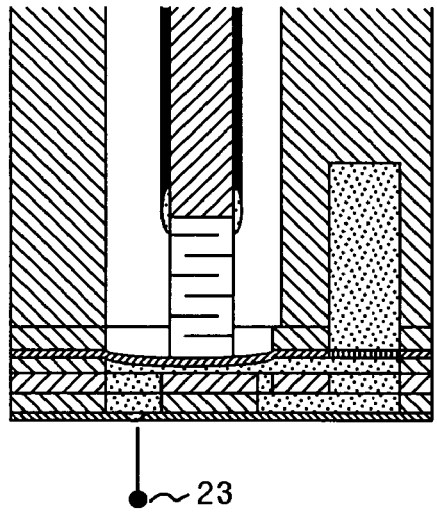
Figure 9:
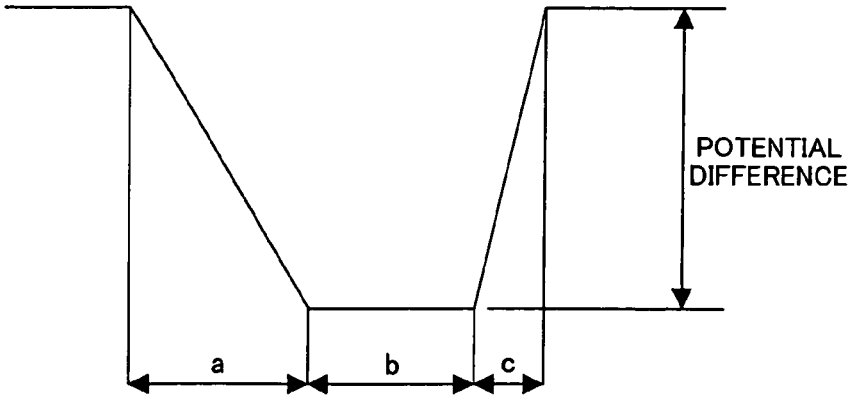
FIG. 9 is a diagram showing an example of a load of an application voltage for discharging an ink.

First, as shown in FIG. 3A, the ink supplied from a not-shown ink supply part is stored in the common ink chamber 6. When the voltage "a" shown in FIG. 9 is applied to the piezoelectric element group 4 in a state where the pressure chamber 15, first ink supply path 16, second ink supply path (17, 20, and 18), and communication holes 19 and 21 are filled with the ink, the piezoelectric element group 4 contracts as shown in FIG. 3B to lift up the diaphragm plate 8. The volume of the pressure chamber 15 expands by the lifting of the diaphragm plate 8, and the ink filled in the periphery is drawn in the pressure chamber 15. When the voltage is maintained as it is ("b" in FIG. 9), pull-in of the meniscus of the ink near a nozzle 22 completes, and the ink returns to the nozzle 22 side by reaction. At this time point, the voltage applied so that the piezoelectric element group 4 expands is released in short time ("c" in FIG. 9). The diaphragm plate 8 returns to the original state by the expansion of the piezoelectric element group 4 by the voltage release, the volume of the pressure chamber 15 is reduced, and the ink in the pressure chamber 15 is pressurized as shown in FIG. 3C. The pressurized ink flows to the outside of the pressure chamber 15. At this time, the ink in the communication holes 19 and 21 isolated from the first ink supply path 16 and the second ink supply path (17, 20, and 18) by the deformation of the diaphragm plate 8 jets as an ink drop 23 from the nozzle 22 as shown in FIG. 3D.

In a series of operations, when the volume of the pressure chamber 15 expands, it is important that the ink flows from the ink supply path into the pressure chamber more than drawing of the meniscus of the ink to the pressure chamber side. That is, when the pull-in of the meniscus is too large, the meniscus at the nozzle 22 cannot be maintained, the outside air is introduced from the meniscus, and air bubbles mixedly exist on the inside. As a result, when the volume of the pressure chamber 15 is reduced, only the air bubbles are jetted and the ink is not jetted. If the amount of ink flowing backward to the ink supply path when the volume of the pressure chamber 15 is reduced, the necessary amount of ink is not jetted. Consequently, it is necessary to increase the amount of ink flowing in from the ink supply path when the pressure chamber 15 expands and to decrease an amount of leakage into the ink supply path when the pressure chamber 15 is reduced. The point of increasing the jetted frequency of the ink is to attenuate vibration generated in the ink supply path as soon as possible by the series of operations. In other words, it is a necessary condition that when the ink flows into the pressure chamber 15, the inertance of the ink supply path is decreased and the inertance of the nozzle 22 is increased, and when the ink is jetted, the resistance of the ink supply path is increased and the resistance of the nozzle 22 is decreased. In the embodiment, however, by constructing the ink supply path by the first ink supply path 16 and the second ink supply path (17, 20, and 18), the necessary condition can be satisfied. That is, by increasing the number of the ink supply paths so that the ink supply paths are provided in parallel, the time constant $\tau$(≈attenuation time) of the vibration calculated by a lumped constant circuit in an acoustic model is decreased by increasing the resistance R without changing the inertance M as expressed as $\tau=2\times(M/R)$, and the attenuation can be hastened. Thus, even if the drive cycle is shortened, the meniscus of the ink around the nozzle 22 can be held in a stable position. As a result, the ink jetted frequency can be increased.

Figure 4:
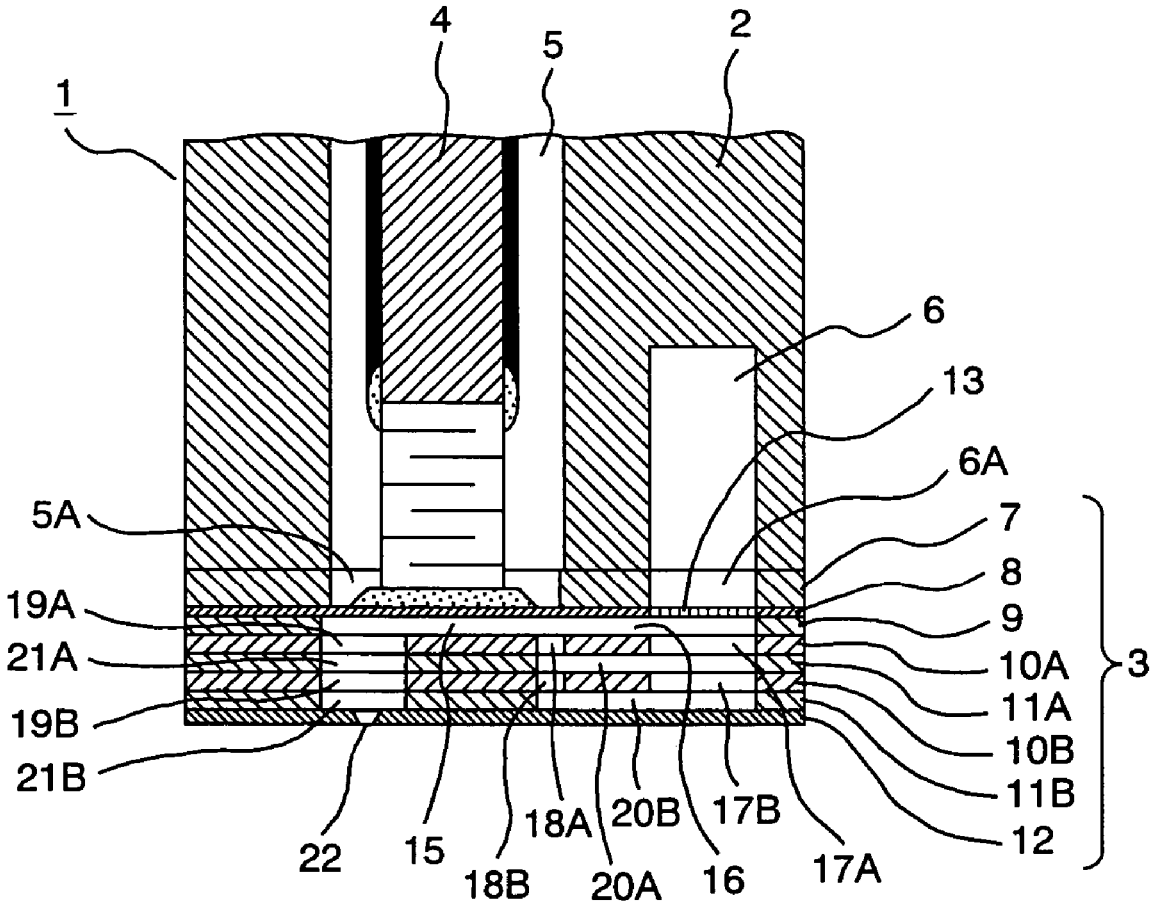
FIG. 4 is a diagram corresponding to FIG. 1, showing a modification of the first embodiment of the ink jet head according to the present invention.

FIG. 4 shows a modification of the first embodiment. The same reference numerals as those in FIGS. 1 to 3 indicate the same parts, so that their detailed description will not be repeated.

In the modification, a second ink supply path extending through communication holes 17A, 20A, and 18A and a second ink supply path extending through communication holes 17B, 20B, and 18B are formed by alternately stacking chamber plates 10A and 10B and chamber plates 11A and 11B. By forming two second ink supply paths as described above, at the time of determining the inertance and the resistance of the second ink supply part in order to increase the ink jetted frequency, flexible designing can be realized. Further, even if air bubbles remain below the filter 13, they can be easily removed via the first ink supply path 16 and the two ink supply paths.

Figure 5:
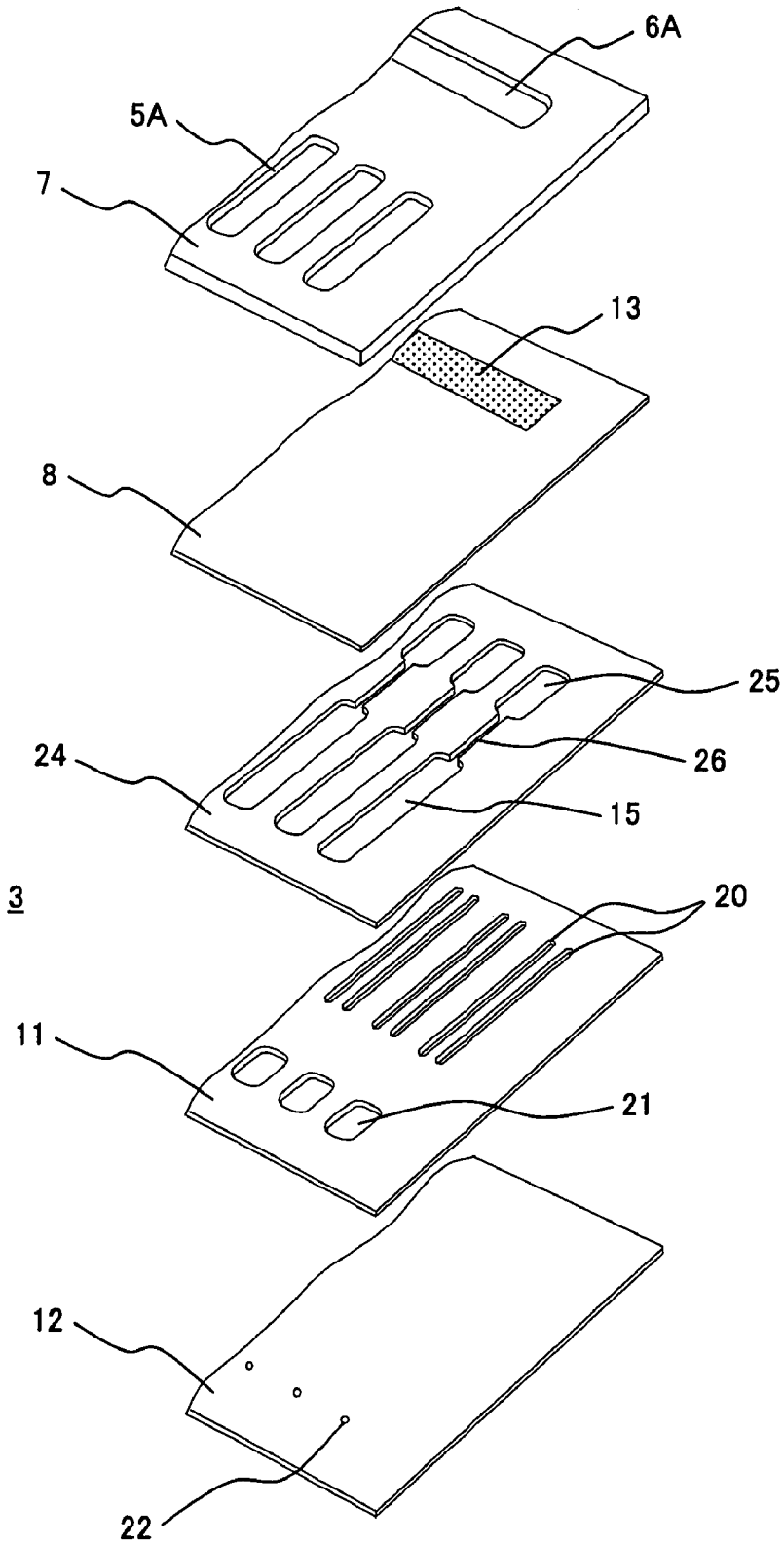
FIG. 5 is a diagram corresponding to FIG. 2, showing a second embodiment of the ink jet head according to the invention.
Figure 6:
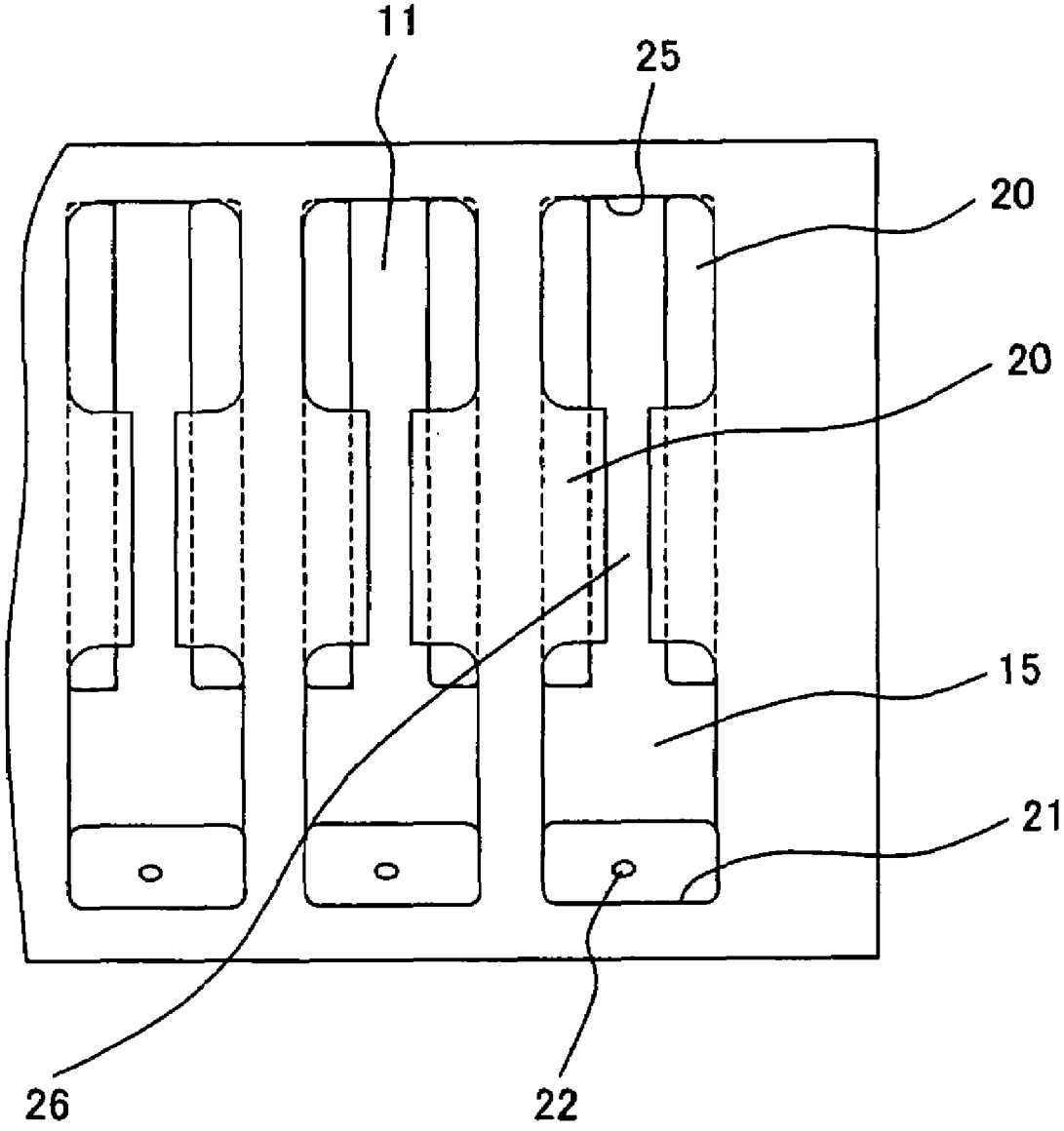
FIG. 6 is a plan view of a path plate group shown in FIG. 5.

FIGS. 5 and 6 show a second embodiment of the invention in which a restrictor plate 24 is interposed in place of the restrictor plate 9 and the chamber plate 10 in the first embodiment. In the restrictor plate 24, a communication hole 25 is formed in a position facing the ink chamber hole 6A in the reinforcement plate 7, and the pressure chamber 15 is formed in a position facing the drive chamber hole 5A. Further, the lo pressure chamber 15 and the communication hole 25 are communicated with each other via a first ink path 26 having a small width. The communication hole 25 has a width covering the two communication holes 20 in the chamber plate 11 positioned below, and the first ink path 26 is formed in a position between the two communication holes 20 so as not to be continued to the communication holes 20.

By stacking such restrictor plates 24, the first ink supply path 26 extending from the communication hole 25 communicated with the ink chamber hole 6A via the filter 13 to the pressure chamber 15 is formed between the diaphragm plate 8 and the chamber plate 11. Between the nozzle plate 12 and the restrictor plate 24, the second ink supply path extending from the communication hole 25 to the pressure chamber 15 via the two communication holes 20 is formed.

The width of each of the first ink supply path 26 and the path of the two communication holes 20 is ⅓ of the width of the pressure chamber 15 or less.

The second embodiment can produce effects similar to those of the first embodiment. In addition, the thickness of the stacked plates of the path plate group 3 can be reduced more than that in the first embodiment by an amount corresponding to the chamber plate 10 in the first embodiment, which is made unnecessary in the second embodiment.

Figure 7:
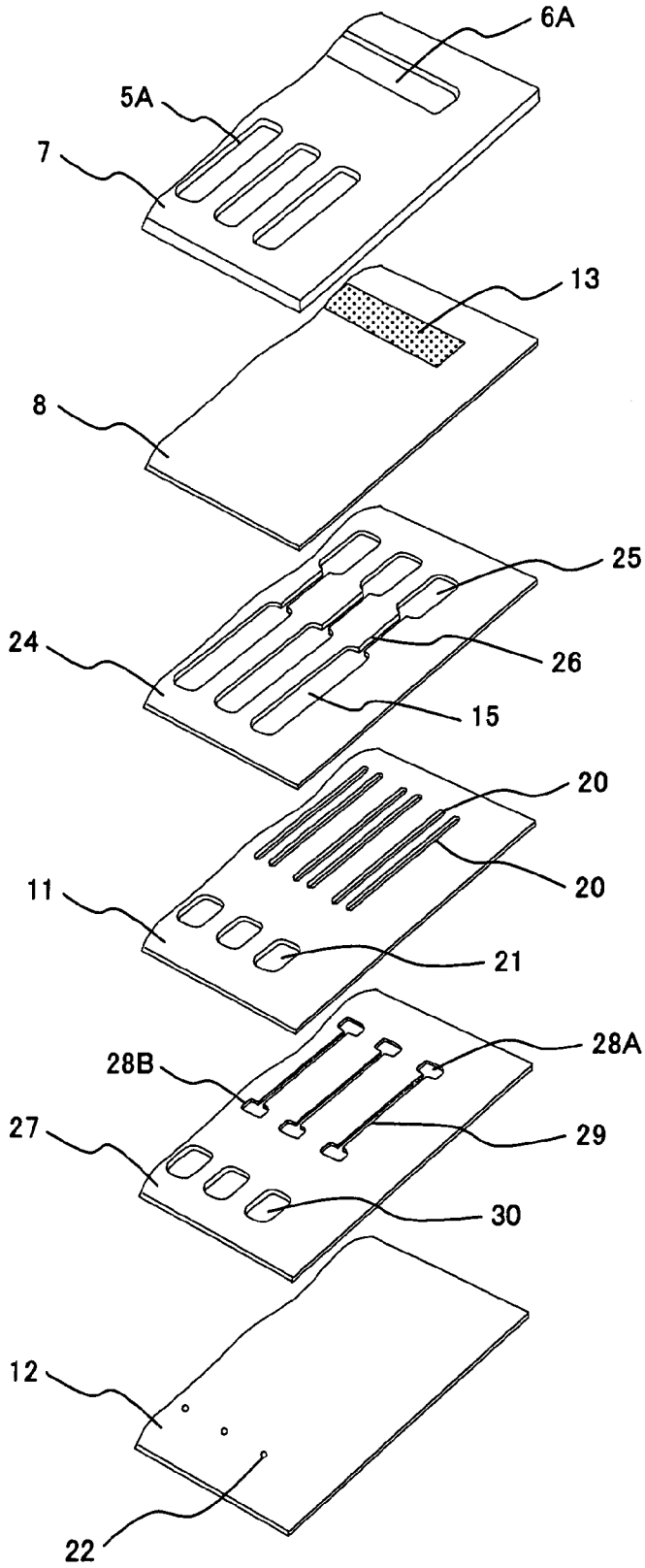
FIG. 7 is a diagram corresponding to FIG. 2, showing a third embodiment of the ink jet head according to the invention.
Figure 8:
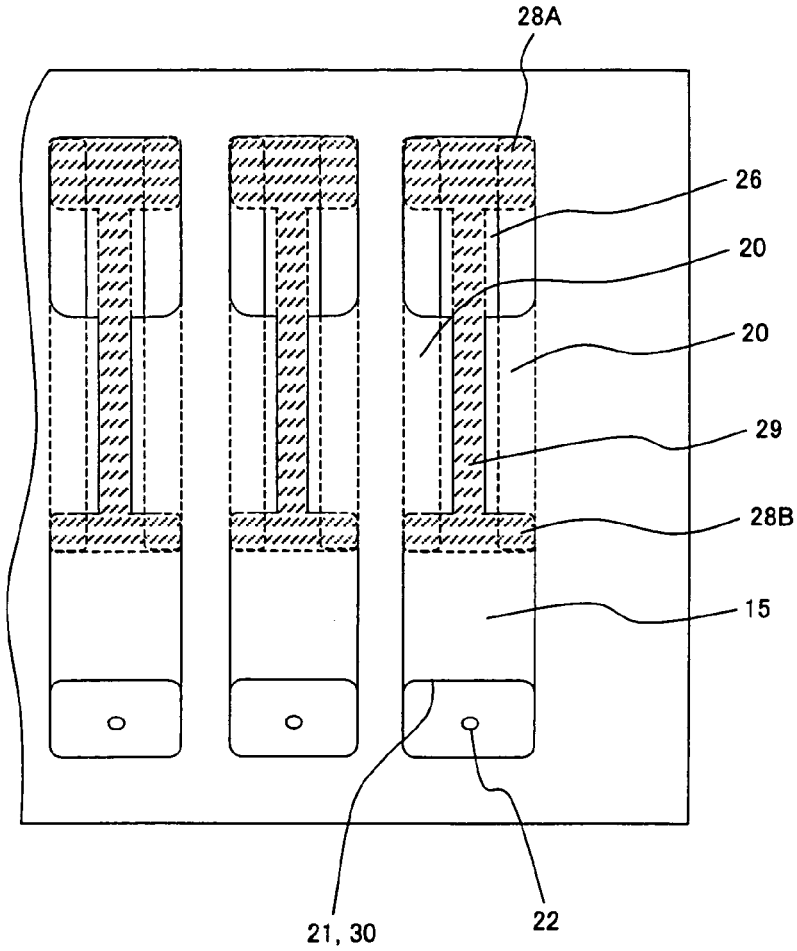
FIG. 8 is a plan view showing a path plate group illustrated in FIG. 7.

FIGS. 7 and 8 show a third embodiment of the present invention, in which another chamber plate 27 is interposed below the chamber plate 11 shown in the second embodiment. In the chamber plate 27, communication holes 28A and 28B are formed in positions facing both ends of the two communication holes 20 in the chamber plate 11. The communication holes 28A and 28B are communicated with each other via a communication hole 29. The communication holes 28A, 28B, and 29 are formed in an I shape as a whole. Further, in the chamber plate 27, a communication hole 30 having the same shape as that of the communication hole 21 in the chamber plate 11 is also formed. The communication holes 28A and 28B have a width covering the two communication holes 20 in the chamber plate 11. The communication hole 29 is formed so as to be positioned between the two communication holes 20 and to be discontinuous with the communication hole 20 like the first ink supply path 26.

By stacking such a chamber plate 27, the first ink supply path 26 extending from the communication hole 25 communicated with the ink chamber hole 6A via the filter 13 to the pressure chamber 15 is formed between the diaphragm plate 8 and the chamber plate 11. The second ink supply path extending from the communication hole 25 to the pressure chamber 15 via the two communication holes 20 is formed between the chamber plate 27 and the restrictor plate 24. Further, the third ink supply path extending from the communication hole 28A communicated with the communication hole 25 via one end of the two communication holes 20 to the pressure chamber 15 via the communication holes 29 and 28B and the other end of the two communication holes 20 is formed between the chamber plate 11 and the nozzle plate 12.

The third embodiment can produce effects similar to those of the first embodiment. In addition, since three ink supply paths are provided between the common ink chamber to the pressure chamber 15, designing for increasing the ink jetted frequency can be performed more freely.

For example, when the diameter of the nozzle 22 is changed to change the ink drop jetting amount, only by the change in the diameter of the nozzle 22, the balance of the inertance and resistance with respect to the first ink path 26 and the communication holes 20 and 29 is lost, and it causes deterioration in the ink drop jetting frequency. However, as described above, by constructing the chamber plates 11 and 27 by stacking thin plate members, a plurality of ink paths can be formed easily. Consequently, the number of ink supply paths can be easily changed in accordance with the inertance and resistance of the nozzle 22. As a result, the balance of the inertance and the resistance of the nozzle 22 and those of the ink supply path is set more easily, and the ink drop jetting frequency can be adjusted by the minimum change.

In the foregoing embodiments and modification, for bonding the plates, for example, an epoxy-resin-based adhesive may be used. Alternately, diffusion bonding for directly bonding metal plates may be also employed. In such a manner, high chemical resistance to a binder and a surface active agent contained in an ink, and, further, other solvents can be obtained. The ink jet head can be used for, for example, discharging a liquid for an alignment film, an organic EL, and the like used for studying a thin film display whose techniques are being improved remarkably.

Although the materials of the plates are not particularly limited unless otherwise corroded by the ink, desirably, the materials have the same coefficient of linear expansion in consideration of bonding temperature at the time of adhesion or diffusion bonding. Although the present invention relates to the stacked structure of plates using thin stainless plates, in the case where higher-precision processing is desired, silicon wafers may be etched and the resultant plates may be bonded by anode bonding technique. Although the piezoelectric element group is constructed by piezoelectric elements obtained by stacking a plurality of piezoelectric materials and electrodes in the present invention, a thin film element may be stacked on a vibration plate and a driving method using an electrostatic method may be also employed.

Figure 10:
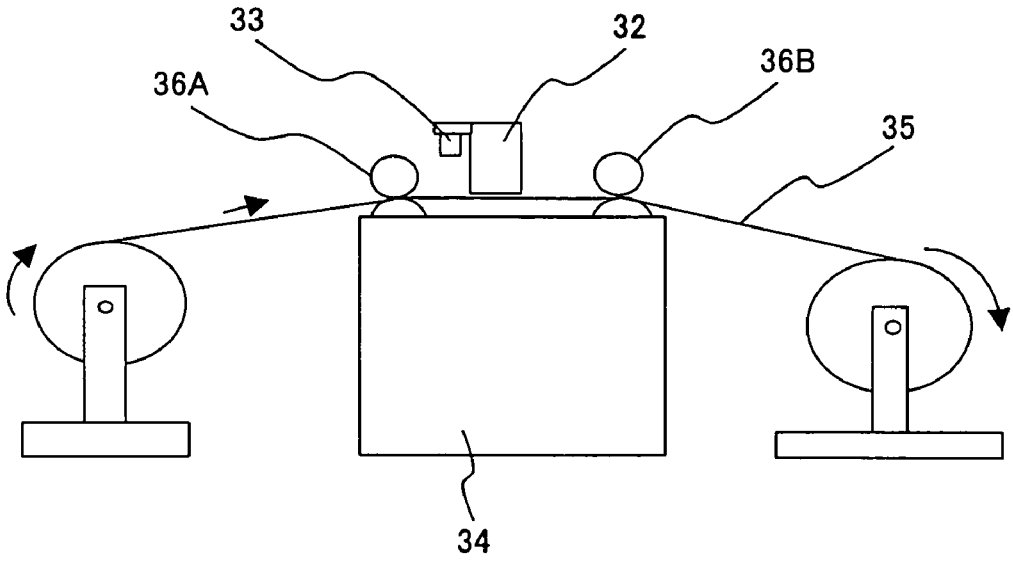
FIG. 10 is a schematic diagram showing a recording apparatus to which the ink jet head according to the invention is applied.
Figure 11:
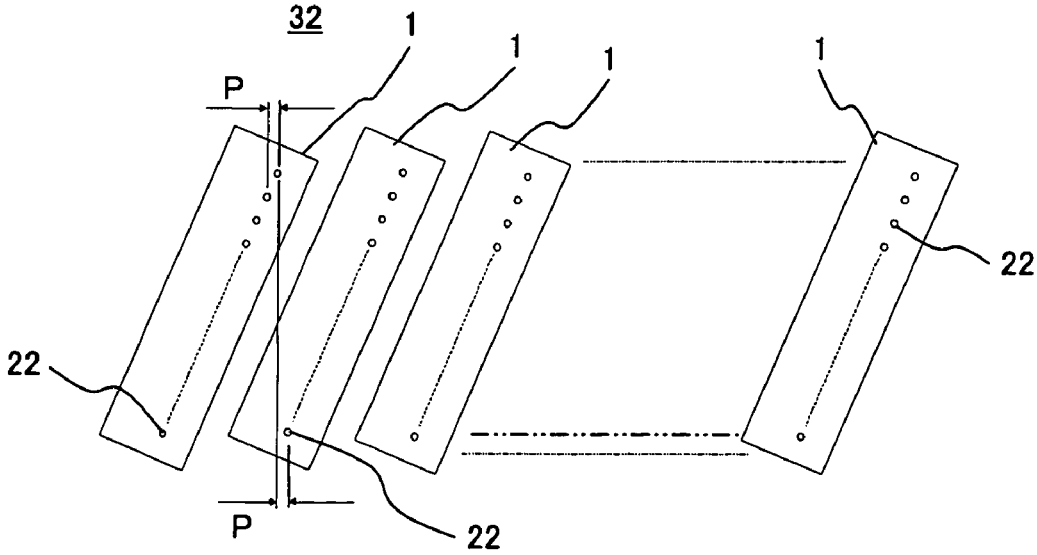
FIG. 11 is an arrangement drawing of an ink jet head as a component of the head unit of FIG. 10.

A recording apparatus using the ink jet head having the above-described configuration will now be described with reference to FIGS. 10 and 11.

A head unit 32 is constructed by arranging a plurality of ink jet heads 1 whose nozzles 22 are open in one direction in parallel in the same direction. The head unit 32 is guided so as to be able to reciprocate along a linear guide rail 33 fixed to a frame (not shown). Below the head unit 32 guided in such a manner, a printing paper sheet 35 fed from a roll is conveyed by a conveyance unit 34. The printing sheet 35 is prevented from moving ups and downs by rollers 36A and 36B disposed on both sides of the head unit 32, and is held to have constant distance from the head unit 32. The ink jet head 1 of the head unit 32 is disposed so that the pitch P between the nozzles 22 coincides with the printing resolution. The head unit 32 can perform line printing by arranging the plurality of ink jet heads 1 which are disposed obliquely in parallel. By the inclination angle of the ink jet heads 1, the nozzle pitch P per head is determined. The ink jet heads 1 are disposed so that the pitch P between the nozzles 22 of adjacent ink jet heads becomes the same as the nozzle pitch P.

To the head unit 32, an ink is supplied from the ink supply part (not shown) in a state where the head unit 32 is fixed in the printing position. The head unit 32 jetting ink drops on demand onto the printing paper sheet 35 conveyed in the direction orthogonal to the maximum printing width to perform recording.

In the case of a high-speed recording apparatus of such a line head type, high-speed printing of 50 to 100 m per minute is requested. The performance is determined by the ink jetting frequency of the ink jet head 1. For example, in the case where the conveyance speed of the printing paper sheet 35 is 100 m/minute and printing resolution in the conveyance direction is 600 dpi (dots/inch), the requested ink jetting frequency of the head is about 40 kHz. An extremely high jetting frequency is requested for an ink jet head of a drop-on-demand type.

The present invention can obtain high jetting frequency by using the ink jet head 1 described in the foregoing embodiments and the modification, so that the ink jet head of the invention can be easily applied to a high-speed recording apparatus.

Although the above-described recording apparatus is an apparatus for performing printing on the printing paper sheet 35, by using a quick drying ink, the ink jet head of the invention can be also applied to an apparatus for performing printing onto not only a printing paper sheet but also a vinyl sheet or the like.

According to the embodiments described above, since the ink supply path is constructed by arranging a first ink supply path formed at the same level as that of the pressure chamber and at least one second ink supply path having the same function as that of the first ink supply path in parallel, at the time of determining the inertance and resistance of the ink supply path, designing can be made very flexibly. As a result, the ink jet head having high ink drop jetting frequency can be obtained. By constructing the ink supply path by stacking a plurality of the same thin plate materials, it becomes easier to arrange a plurality of the ink supply paths in parallel. Consequently, it becomes easier to adjust the inertance and resistance on the ink supply path side in accordance with the inertance and resistance on the nozzle side. Thus, the ink jet head capable of adjusting the jetting frequency by a minimum change can be obtained.

What is claimed is:

1. An ink jet head comprising:

a common ink chamber for storing an ink supplied from an ink supply part;

an ink supply path for supplying the ink stored in the common ink chamber;

pressure chambers to which the ink is supplied via the ink supply path; and nozzles for discharging the ink in the pressure chamber in accordance with a pressure change in the pressure chamber, the components being constructed by stacking a plurality of thin plate members, wherein the ink supply path is constructed by arranging a first ink supply path formed at the same level as that of the pressure chamber and at least one second ink supply path having the same function as that of the first ink supply path in parallel, and the first and second ink supply paths are constructed of the plurality of thin plate members interposed between a diaphragm plate and a nozzle plate, and wherein the second ink supply path is communicated with the pressure chamber formed at the same level as that of the first ink supply path.

2. The ink jet head according to claim 1, wherein the first and second ink supply paths are communicated with the pressure chamber via a common communication path.

3. An ink jet head comprising:

a common ink chamber for storing an ink supplied from an ink supply part;

an ink supply path for supplying the ink stored in the common ink chamber;

a pressure chamber to which the ink is supplied via the ink supply path; and a downward nozzle provided at a level lower than the pressure chamber and for discharging the ink in the pressure chamber in accordance with a pressure change in the pressure chamber, the components being constructed by stacking a plurality of thin plate members, wherein the ink supply path is formed by a first ink supply path formed at the same level as that of the pressure chamber and a second ink supply path provided at a level lower than the first ink supply path, and the first and second ink supply paths are constructed of the plurality of thin plate members interposed between a diaphragm plate and a nozzle plate, and wherein the second ink supply path is communicated with the pressure chamber formed at the same level as that of the first ink supply path.

4. The ink jet head according to claim 3, wherein each of the width of the first ink supply path and that of the second ink supply path is smaller than the width of the pressure chamber.

5. The ink jet head according to claim 4, wherein when the number of the first and second ink supply paths is "n", the width of the second ink supply path is 1/n of the width of the pressure chamber or less.

6. The ink jet head according to claim 1, wherein the plurality of thin plate members are made of materials having almost the same coefficient of linear expansion.

7. The ink jet head according to claim 3, wherein the plurality of thin plate members are made of materials having almost the same coefficient of linear expansion.

8. An ink jet head comprising:

a common ink chamber for storing an ink supplied from an ink supply part;

a plurality of ink supply paths for supplying the ink stored in the common ink chamber;

a pressure chamber to which the ink is supplied via the ink supply path; and a nozzle for discharging the ink in the pressure chamber in accordance with a pressure change in the pressure chamber, the components being constructed by stacking a plurality of thin plate members, wherein ink supply paths are arranged in parallel, and are constructed of the plurality of thin plate members interposed between a diaphragm plate and a nozzle plate, and wherein the second ink supply path is communicated with the pressure chamber formed at the same level as that of the first ink supply path.

9. The ink jet head according to claim 8, wherein the plurality of thin plate members are made of materials having almost the same coefficient of linear expansion.

10. The ink jet head according to claim 9, wherein the ink supply paths have a structure in which an inertance and a resistance are adjusted on the ink supply path side in accordance with the number of the ink supply paths.

* * * * *

UNITED STATES PATENT AND TRADEMARK OFFICE

CERTIFICATE OF CORRECTION

PATENT NO. : 7,654,652 B2
APPLICATION NO. : 11/214822
DATED : February 2, 2010
INVENTOR(S) : Satoru Tobita et al.

It is certified that error appears in the above-identified patent and that said Letters Patent is hereby corrected as shown below:

Title Page, please insert

-- (30) Foreign Application Priority Data

Aug. 31, 2004 (JP) 2004-251677 --.

Signed and Sealed this

Sixth Day of April, 2010

David J. Kappos

David J. Kappos
*Director of the United States Patent and Trademark Office*